United States Patent [19]

Takegawa

[11] Patent Number: 4,815,502

[45] Date of Patent: Mar. 28, 1989

[54] PICKING CONTROL METHOD AND PICKING CONTROLLER

[75] Inventor: Yujiro Takegawa, Ishikawa, Japan

[73] Assignee: Tsudakoma Corp., Ishikawa, Japan

[21] Appl. No.: 83,585

[22] Filed: Aug. 10, 1987

[30] Foreign Application Priority Data

Aug. 11, 1986 [JP] Japan ..... 61-189116

[51] Int. Cl.[4] ..... D03D 47/36

[52] U.S. Cl. ..... 139/452

[58] Field of Search ..... 139/435, 450, 452

[56] References Cited

U.S. PATENT DOCUMENTS

| | | | |
|---|---|---|---|
| 4,450,876 | 5/1984 | Mullekom | 139/435 |
| 4,550,753 | 11/1985 | Tsuji | 139/435 |
| 4,627,474 | 12/1986 | Tholander | 139/452 |
| 4,673,004 | 6/1987 | Rosseel et al. | 139/435 |
| 4,702,285 | 10/1987 | Sugita | 139/452 |

FOREIGN PATENT DOCUMENTS 60-259652 12/1985 Japan .

*Primary Examiner*—Henry S. Jaudon

*Attorney, Agent, or Firm*—Wenderoth, Lind & Ponack

[57] ABSTRACT

A picking control method includes the steps of detecting a change in the supply yarn package during the weaving operation, preferentially setting a specific checking pin retracting time in which the checking pin is to be retracted for picking cycles for a predetermined time period after the detection of the change of the supply yarn package, and controlling the advancing and retracting operation of the checking pin on the basis of a new checking pin retracting time. A picking controller for carrying out this method has a supply yarn package change detector for detecting the change of the supply yarn package and for issuing a supply yarn package change detection signal, an initial data setting device for providing a checking pin retracting time in which the checking pin is to be retracted to release the weft yarn supplied from the new supply yarn package and wound on the measuring and storing drum, a data updating device generating a checking pin retracting time, a memory device, and a control unit.

3 Claims, 2 Drawing Sheets

PICKING CONTROL METHOD AND PICKING CONTROLLER

BACKGROUND OF THE INVENTION

1. Field of the Invention

The present invention relates to a picking unit for a fluid jet loom and, more particularly, to a method and device for controlling the checking pin of a drum type weft measuring and storing device for a fluid jet loom.

2. Description of Related Art

When the yarn package on a fluid jet loom is changed during a picking operation, the size of the balloon and the resistance to unwinding the yarn from the yarn package changes due to a sudden change in the diameter of the yarn package and in the physical properties of the yarn. Consequently, the picking speed varies even though the operating conditions of the fluid jet loom are unchanged. The variation of the picking speed causes the time at which the extremity of a picked weft arrives at a predetermined position on the arrival side opposite to the picking side of the fluid jet loom to vary, so that the fluid jet loom is unable to operate normally.

Accordingly, the picking speed must be changed, or else the synchronous operation of the fluid jet loom will be disrupted, to ensure a correct picking operation synchronous with the principal motions of the fluid jet loom.

Means for changing the picking speed are disclosed, for example, in Japanese Laid-Open Patent Publication No. 58-18446 and Japanese Laid-Open Utility Model Publication No. 60-136379. According to those known means, when a yarn package is changed, the pressure of the picking fluid is changed or the timing of the operation of the picking nozzle is changed. However, since the device controlled by those known methods is the picking nozzle, the methods are not directly applicable to controlling the checking pin of a drum type weft yarn storing device.

Japanese Laid-Open Utility Model Publication No. 61-82973 discloses a further method for controlling the picking operation, in which the checking pin releasing timing is changed according to the amount of the picking force. However, since this method does not include any means for dealing with a package change, the same is not suitable for solving the problem associated with variations in the picking operation attributable the package change.

SUMMARY OF THE INVENTION

Accordingly, it is an object of the present invention to provide a picking control method and a picking controller capable of temporarily changing the checking pin retracting timing when the yarn package is changed so that the picking timing is changed automatically for facilitating a synchronous picking operation.

According to the present invention, the change of the yarn package is detected, the current checking pin retracting timing is changed to a temporary checking pin retracting timing appropriate for the initial diameter of the yarn package, and then the temporary checking pin retracting timing is regulated according to the actual running mode of the picked weft yarn during the subsequent picking cycles. The running mode of the picked weft yarn is monitored continuously during the weaving operation at the arrival position or at an unwinding position to obtain measured data representing the actual running mode of the picked weft yarn, and the checking pin retracting timing is regulated properly on the basis of the average of the measured data to change the checking pin retracting timing depending on the change of the diameter of the yarn package. Accordingly, an appropriate picking operation is continued through the weaving operation regardless of a change in the yarn package diameter.

According to the present invention, upon the change of the yarn package, the current checking pin retracting timing is cancelled automatically and a temporary checking pin retracting timing is set automatically. Consequently, the change of the yarn package does not cause the weft yarn arrival time to change excessively, and hence a stable picking operation can be continued.

DETAILED DESCRIPTION OF THE PREFERRED EMBODIMENT

Figure 1:
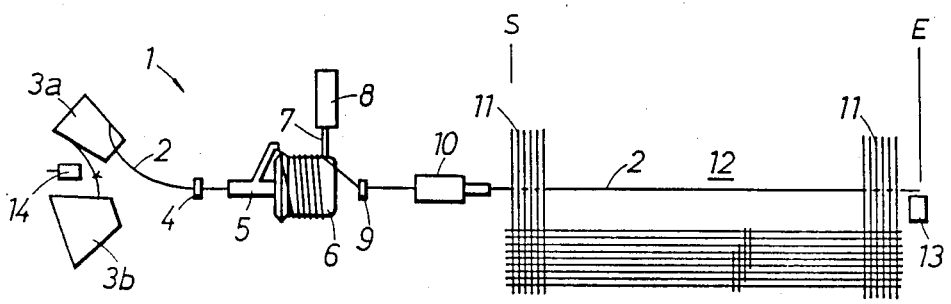
FIG. 1 is a schematic plan view of a picking device.

Referring to FIG. 1 generally showing a picking device to which the present invention is applied, a weft yarn 2 is unwound from either a yarn package 3*a* or a yarn package 3*b*, and then the unwound weft yarn 2 is guided by a balloon guide 4 into a hollow winding arm 5, which rotates about an axis of rotation aligned with the axis of a stationary measuring and storing drum 6 to wind the weft yarn 2 in loops around the measuring and storing drum 6.

A checking pin 7 is moved radially of the drum 6 to maintain the weft yarn 2 on or to release the weft yarn 2 from the drum 6. That is, the checking pin 7 is capable of being moved radially of the drum 6 by an actuator 8 such as an electromagnetic actuator. When the checking pin 7 is moved onto or off of the drum 6, weft insertion is stopped or effected. To check the weft yarn 2 for stopping weft insertion and for causing the weft yarn 2 to be stored on the drum 6, the actuator 8 advances the checking pin 7 to insert the checking pin 7 into a hole or a groove formed in the circumference of the drum 6. When the weft yarn 2 needs to be unwound from the drum 6 for facilitating a picking operation, the checking pin 7 is retracted by the actuator 8 to release the weft yarn 2 stored on the drum 6. Then, the weft yarn 2 thus released is picked into a shed 12 of warp yarns 11 with picking fluid by a picking nozzle 10. The arrival of the weft yarn 2 at an arrival position, namely, a position on the side of the fluid jet loom opposite to the side on which the picking device is provided, is detected by a detector 13 such as a photoelectric sensor. The trailing end of the weft yarn 2 wound on the yarn package 3*a* is tied to to the yarn wound on yarn package 3*b*, and after the yarn wound on yarn package 3*a* has been exhausted, a supply yarn package change detector 14 detects the trailing end, i.e. a change of the supply yarn package, and issues a detection signal to a picking controller 15.

Figure 2:
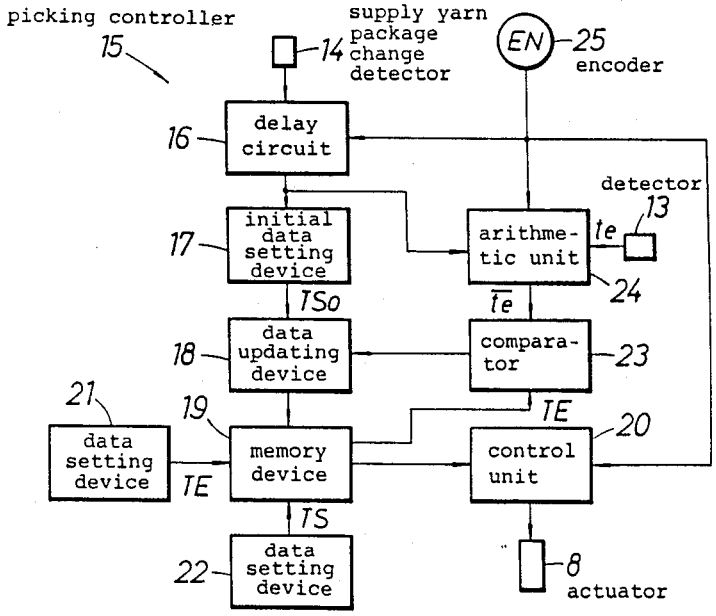
FIG. 2 is a block diagram of a picking controller, in a preferred embodiment, according to the present invention.

Referring to FIG. 2 showing the picking controller 15 embodying the present invention, the supply yarn package change detector 14 is connected to a delay circuit 16 such as a counter, an initial data setting device 17, data updating device 18, a memory device 19 and a control unit 20, which are in turn connected, sequentially, to the actuator 8. The two input terminals of the memory device 19 are connected to data setting devices 21 and 22, respectively. Another output terminal of the memory device 19 is connected to a comparator 23 connected to the data updating device 18. On the other hand, an arithmetic unit 24 has an input terminal connected to the delay circuit 16, another input terminal connected to the detector 13, and an output terminal connected to the comparator 23. An encoder 25 detects the phase angle of the loom and issues phase data representing the phase angle of the loom to the delay circuit 16, the arithmetic unit 24 and the control unit 20.

Figure 3:
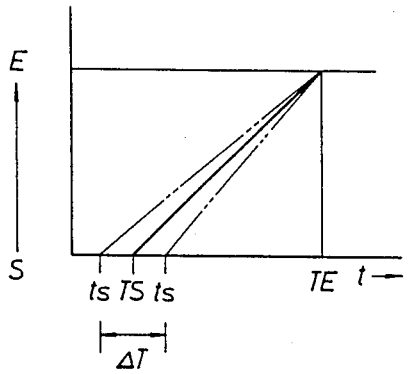
FIG. 3 is a graph showing the relation between unwinding time and arrival time.

In the graph shown in FIG. 3, positive values for time t are plotted on the horizontal axis, positive values for the length of travel of the free end of the picked weft yarn 2 are plotted on the vertical axis, a point S indicates a picking starting position, and a point E indicates an arriving position. A picking time, namely, a standard checking pin retracting time TS, is predetermined and a standard arrival time TE, namely, the time at which the free end of the picked weft yarn 2 arrives at the arrival position E is determined accordingly. Provided that the picked weft yarn 2 runs across the shed 12 at a fixed running speed, the distance of travel of the weft yarn 2 as a function of time t is expressed by a straight line as shown in FIG. 3, in which the gradient of the straight line corresponds to the fixed running speed of the picked weft yarn 2.

As mentioned above, since the variation of weft yarn supplying conditions causes the running speed of the picked weft yarn 2 to vary, the actual checking pin retracting time ts needs to be varied to enable the picked weft yarn 2 to arrive at the arrival position E at the standard arrival time TE. For example, if the actual running speed is lower than the standard running speed, the actual checking pin retracting time ts must be advanced accordingly relative to the standard checking pin retracting time TS and vice versa. Time ΔT in FIG. 3 is a range of adjustment of the actual checking pin retracting time ts based on an actual running speed range defined between a maximum running speed and a minimum running speed.

Figure 4:
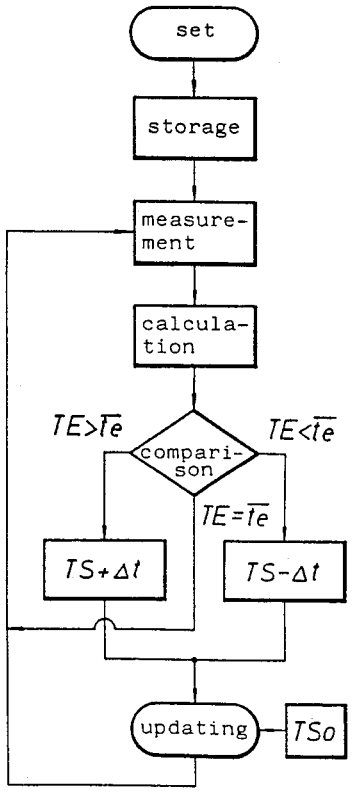
FIG. 4 is a flow chart showing the steps of a picking control method, in a preferred embodiment, according to the present invention.

Referring to FIG. 4 showing a series of picking control procedures to be executed by the picking controller 15, the standard arrival time TE and the standard checking pin retracting time TS are input by means of the data setting devices 21 and 22 to the memory device 19, and a temporary checking pin retracting time $TS_0$ for the initial period of the picking operation after the supply yarn package has been changed from the yarn package 3*a* to the yarn package 3*b* is input by means of the initial data setting device 17.

While the picking device 1 is operating, the detector 13 disposed at the arrival side detects the arrival of the free end of the picked weft yarn 2 at the arrival position E and issues a detection signal to the arithmetic unit 24 while the encoder 25 transmits phase angle signals respectively representing momentary phase angles of the main shaft of the loom. Then, the arithemtic unit 24 reduces the detection signal into a corresponding phase angle of the main shaft of the loom. The arithmetic unit 24 calculates the moving average $\overline{te}$ of the actual arrival times te at every successive one several picking cycles and inputs the moving average to the comparator 23. Then, the comparator 23 compares the moving average $\overline{te}$ of the measured arrival times te and the standard arrival time TE stored in the memory device 19. When (standard arrival time TE)=(moving average $\overline{te}$ of the measured arrival times te) as indicated by the continuous line in FIG. 3, the picking operation is normal, and hence any particular correcting operation is unnecessary.

Figure 5:
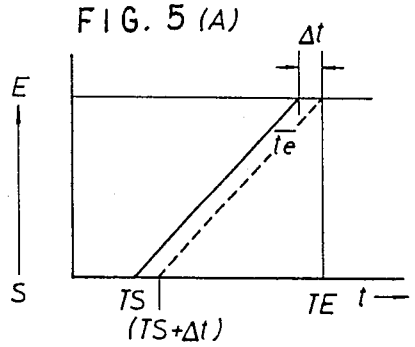
FIGS. 5(A) and 5(B) are graphs explanatory of a process of correcting the checking pin retracting timing.
Figure 5:
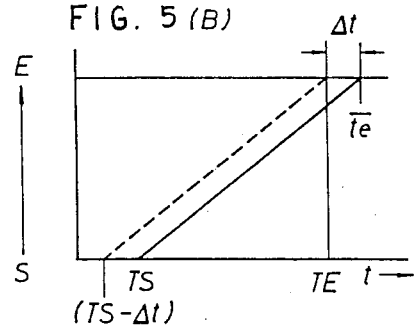

When (standard arrival time TE)>(moving average $\overline{te}$ of the measured arrival times te) as shown in FIG. 5(A), the actual running speed of the picked weft yarn 2 is higher than the standard running speed. Then, the time difference+Δt, namely, the deviation of the moving average $\overline{te}$ of the measured arrival times te from the standard arrival time TE is added to the standard checking pin retracting time TS by the data updating device 18 to store a new checking pin retracting time TS+Δt in the memory device 19. Thereafter, the control unit 20 controls the actuator 8 so as to retract the checking pin 7 in the new checking pin retracting time TS+Δt.

When (standard arrival time TE)<(moving average $\overline{te}$ of the measured arrival times te) as shown in FIG. 5(B), the actual running speed of the picked weft yarn 2 is lower than the standard running speed. Then, the time difference−Δt, namely, the deviation of the moving average $\overline{te}$ of the measured arrival times te from the standard arrival time TE, is added to the standard checking pin retracting time TS to store a new checking pin retracting time TS−Δt in the memory device 19. Thereafter, the control unit 20 controls the actuator 8 so as to retract the checking pin 7 in the new standard checking pin retracting time TS−Δt.

Thus, the actual arrival time te is corrected automatically and continuously to adjust the actual arrival time gradually to a target arrival time, i.e., the standard arrival time TE. Consequently, the free end of the picked weft yarn 2 arrives at the arrival position E at the standard arrival time TE.

The actual checking pin retracting time ts varies above and below the standard checking pin retracting time TS. The earlier limit time of the time range ΔT corresponds to a preliminary jetting starting time when the picking nozzle 10 begins its preliminary jetting operations. However, if the time relation between the retraction of the checking pin 7 and the start of the preliminary jetting operation is desired to be maintained constant, it is necessary to vary the jetting starting timing of the picking nozzle 10 as well as the checking pin retracting timing. Accordingly, the use of the picking controller 15 is not limited to only controlling the checking pin 7, but the picking controller 15 can also be used for the continuous regulation of the jetting starting timing of the picking nozzle 10 relative to or independently from the timing of the preliminary jetting operations.

When the yarn wound around the yarn package 3*a* is exhausted, the weft yarn 2 wound on the yarn package 3*b* is supplied for picking. The change of the supply yarn package from the yarn package 3*a* to the yarn package 3*b* is detected by the supply yarn package change detector 14. Upon the detection of the change in the supply yarn package, the supply yarn package change detector 14 issues a detection signal to the delay circuit 16. Then, the delay circuit 16 issues a reset signal to the initial data setting device 17 and the arithemtic unit 24 after a predetermined time corresponding to a predetermined number of picking cycles or a predetermined angular rotation of the main shaft of the loom after the the detection signal from the supply yarn package change detector 14 has been received by delay circuit 16. Then, the initial data setting device 17 inputs a checking pin retracting time $TS_0$ for a supply yarn package change mode to the data updating device 18, and the checking pin retracting time $TS_0$ is stored preferentially in the memory device 19. Then, the arithmetic unit 24 erases the previously stored checking pin retracting time $TS \pm \Delta t$. Thus, the weft yarn 2 supplied from the yarn package **3*b* which has replaced the weft yarn 2 supplied from the yarn package 3*a* is picked at the checking pin retracting time $TS_0$ from the first picking cycle for picking the weft yarn 2 supplied from the yarn package 3*b*. When a predetermined time after the change of the supply yarn package lapses, the picking controller 15** detects the actual arrival times te in the manner as stated above, and updates the stored data to provide a new checking pin retracting time $TS \pm \Delta t$.

The predetermined delay defined by time or by the number of picking cycles before the new checking pin retracting time corresponds to a time is set between the change of the supply yarn package from the yarn package **3*a* to the yarn package 3*b* and the start of picking the weft yarn 2 supplied from the new yarn package 3*b*. In a multicolor loom provided with a plurality of picking devices, since each picking device does not function continuously, the delay before the first picking cycle for a new supply yarn package after the supply yarn package has been changed must be determined properly for each picking device taking into consideration the picking operation time of each picking device. When the picking controller is adapted for controlling the jetting starting timing of the picking nozzle 10** as well as the checking pin retracting timing, both the jetting starting timing and the checking pin retracting timing must be changed simultaneously when the supply yarn package is changed.

In the foregoing embodiment, the actual arrival time te is detected directly at the arrival position. However, the arrival time can be detected indirectly through the detection of a time when the weft yarn 2 is unwound from the drum 6 by a specific number of loops necessary for one picking cycle. Accordingly, the arrival time may be detected on the picking side of the loom.

What is claimed is:

1. A method of controlling a picking operation of a picking device in which weft yarn disposed on respective yarn packages is sequentially supplied into the device and introduced into a shed, the picking device including a measuring and storing drum, means for winding lengths of the weft yarn onto the measuring and storing drum, a checking pin movably mounted in the device adjacent the measuring and storing drum so as to be continually movable into engagement with the drum to maintain the wound lengths of the weft yarn on the drum and retractable from the drum to release the wound lengths of the weft yarn on the drum, a picking nozzle for picking the weft yarn when released on the drum into the shed in successive picking cycles, and a picking controller operatively connected to the checking pin for detecting the actual arrival of the picked weft yarn at a predetermined arrival position and for regulating the time at which the checking pin is retracted from the drum based on a deviation between the time at which the picked weft yarn actually arrives at the predetermined arrival position and a predetermined standard arrival time, said method comprising:

detecting a change in the supply of weft yarn into the device from weft yarn disposed on one of the yarn packages to weft yarn disposed on another of the yarn packages during the picking operation;

after the detection of the change in the supply of weft yarn, controlling the checking pin to retract from the drum at predetermined control times over a predetermined period of time; and after said predetermined period of time lapses, controlling the checking pin to move into engagement with and retract from the drum at new control times.

2. In a picking device for sequentially introducing weft yarn disposed on respective yarn packages into a shed, the picking device including a measuring and storing drum, means for winding lengths of the weft yarn onto the measuring and storing drum, a checking pin movably mounted in the device adjacent the measuring and storing drum so as to be continually movable into engagement with the drum to maintain the wound lengths of the weft yarn on the drum and retractable from the drum to release the wound lengths of the weft yarn on the drum, a picking nozzle for picking the weft yarn when released on the drum into the shed in successive picking cycles, and a picking controller operatively connected to the checking pin for detecting the actual arrival of the picked weft yarn at a predetermined arrival position and for regulating the time at which the checking pin is retracted from the drum based on a deviation between the time at which the picked weft yarn actually arrives at the predetermined arrival position and a predetermined standard arrival time, the improvement comprising:

said picking controller including a supply yarn package detector for detecting a change in the supply of weft yarn into the device from weft yarn disposed on one of the yarn packages to weft yarn disposed on another of the yarn packages during the picking operation and for issuing a signal when the change in the supply is detected, an initial data setting device operatively connected to said supply yarn package detector for receiving the signal issued therefrom, for controlling the checking pin to retract from the measuring and storing drum at predetermined control times when the yarn supplied from said another yarn package is initially wound on the drum, and for issuing a signal indicative of the control of the checking pin, a data updating device operatively connected to said initial data setting device for receiving the signal issued by the initial data setting device, and for generating data, corresponding to desired control times at which the checking pin is to be retracted from the measuring and storing drum, when the signal issued by said initial data setting device is received, a memory device operatively connected to said data updating device for storing the data generated by the data updating device and for outputting the data; and a control unit operatively connected to said memory device for controlling the checking pin in accordance with the data output by the memory device.

3. An improvement in a picking device as claimed in claim 2, wherein said memory device outputs said data only after at least the first picking cycle is performed by said picking nozzle with weft yarn supplied to the device that was disposed on the another of the yarn packages.

* * * * *